US011738558B2

(12) United States Patent
Galliker

(10) Patent No.: US 11,738,558 B2
(45) Date of Patent: Aug. 29, 2023

(54) ELECTROHYDRODYNAMIC PRINT HEAD WITH SHAPING ELECTRODES AND EXTRACTION ELECTRODES

(71) Applicant: Scrona AG, Adliswil (CH)

(72) Inventor: Patrick Galliker, Richterswil (CH)

(73) Assignee: SCRONA AG, Adliswil (CH)

( * ) Notice: Subject to any disclaimer, the term of this patent is extended or adjusted under 35 U.S.C. 154(b) by 0 days.

(21) Appl. No.: 17/761,400

(22) PCT Filed: Sep. 18, 2019

(86) PCT No.: PCT/EP2019/075045

§ 371 (c)(1),
(2) Date: Mar. 17, 2022

(87) PCT Pub. No.: WO2021/052580

PCT Pub. Date: Mar. 25, 2021

(65) Prior Publication Data

US 2022/0363059 A1 Nov. 17, 2022

(51) Int. Cl.
*B41J 2/14* (2006.01)

(52) U.S. Cl.
CPC ..... *B41J 2/14314* (2013.01)

(58) Field of Classification Search
CPC ..... B41J 2/04; B41J 2/06; B41J 2/02; B41J 2/07; B41J 2/035; B41J 2002/061; B41J 2002/062; B41J 2/14314; B41J 2/14; B41J 2002/14411; B41J 2002/14443; B41J 2002/14475
See application file for complete search history.

(56) References Cited

U.S. PATENT DOCUMENTS 3,949,410 A 4/1976 Bassous et al.
4,403,234 A 9/1983 Miura et al.
(Continued)

FOREIGN PATENT DOCUMENTS

EP 3 050 706 8/2016
WO 99/17083 4/1999
(Continued)

OTHER PUBLICATIONS

Int'l Search Report (Form PCT/ISA/210) conducted in Int'l Appln. No. PCT/EP2019/075045 (dated Jun. 4, 2020).
(Continued)

*Primary Examiner* — Kristal Feggins
(74) *Attorney, Agent, or Firm* — GREENBLUM & BERNSTEIN, P.L.C.

(57) ABSTRACT

The electrohydrodynamic print head comprises a plurality of nozzles. Each nozzle has a central nozzle duct laterally surrounded by a nozzle wall. The top end of the nozzle duct communicates with an ink feed duct. An annular trench laterally surrounds the nozzle. An extraction electrode is located around the axis of the nozzle at a level below it, and a shaping electrode located laterally outside the nozzle duct. The shaping electrode is arranged within a ring having a horizontal width of less than the vertical distance between said shaping electrode and the extraction electrode or it is located above the trench. Both these measures allow to operate the device with high voltages with reduced risk of electrical breakdown.

29 Claims, 4 Drawing Sheets

(56) References Cited

U.S. PATENT DOCUMENTS

| | | | | |
|---|---|---|---|---|
| 4,829,325 | A | 5/1989 | Iwasawa et al. | |
| 6,231,177 | B1 | 5/2001 | Cherukuri et al. | |
| 8,657,419 | B2 * | 2/2014 | Panchawagh | B41J 2/085 347/76 |
| 10,336,071 | B2 | 7/2019 | Poulikakos et al. | |
| 2009/0179939 | A1 | 7/2009 | Ide et al. | |
| 2010/0277552 | A1 * | 11/2010 | Xie | B41J 2/09 347/77 |
| 2012/0019604 | A1 * | 1/2012 | Zeng | B41J 2/03 347/77 |
| 2013/0194339 | A1 * | 8/2013 | Hawkins | B41J 2/105 347/15 |
| 2018/0009223 | A1 | 1/2018 | Poulikakos et al. | |

FOREIGN PATENT DOCUMENTS

| | | |
|---|---|---|
| WO | 2016/120381 | 8/2016 |
| WO | 2016/169956 | 10/2016 |

OTHER PUBLICATIONS

Int'l Written Opinion (Form PCT/ISA/237) conducted in Int'l Appln. No. PCT/EP2019/075045 (dated Jun. 4, 2020).

* cited by examiner

ELECTROHYDRODYNAMIC PRINT HEAD WITH SHAPING ELECTRODES AND EXTRACTION ELECTRODES

TECHNICAL FIELD

The invention relates to an electrohydrodynamic print head. This is a print head where electrical fields are used to eject and accelerate the ink from nozzles onto a target to be printed on. The invention also relates to a method for operating such a print head and a printer for carrying out this method.

BACKGROUND ART

WO 2016/120381 describes an electrohydrodynamic print head having an ink feed duct, a nozzle laterally surrounded by a trench, and an extraction electrode located at a level below said nozzle. Further, a device layer is located laterally outside the trench.

The ink is released from the nozzle's bottom opening by applying an electrical potential to the extraction electrode that is sufficiently different form the potential of the ink.

Discharges or breakdowns between the extraction electrode and the device layer may limit the voltage that can be applied to the extraction electrode.

DISCLOSURE OF THE INVENTION

The problem to be solved by the present invention is to provide an electrohydrodynamic print head and a printer and method that are less prone to breakdown or discharge effects.

This problem is solved by the print head of claim 1.

Accordingly, the print head comprises

At least one nozzle. The nozzle has a central nozzle duct for guiding the ink. The central nozzle duct is laterally surrounded by a nozzle wall.

An annular trench laterally surrounding the nozzle: This trench prevents the ink from overflowing from the bottom end of the nozzle.

An extraction electrode located around an axis of the nozzle at a level below the nozzle: By applying a sufficiently large electrical potential to the extraction electrode (as compared to the ink potential), ink can be extracted from the nozzle.

A shaping electrode: This electrode is located laterally outside the nozzle duct. It can be used for laterally shaping the ink meniscus at the bottom end of the nozzle. In this context, a certain tolerance of the vertical location of the shaping electrode is advantageously allowed for because a small vertical displacement does not greatly affect the electrostatic forces generated by the shaping electrode. Hence, the shaping electrode is considered to be "located laterally outside" the nozzle duct if at least part of it i) is located at a level intersecting the nozzle duct or ii) at a level having a vertical distance from the upper or lower end of the nozzle duct, with said vertical distance being less than the radius of the nozzle, in particular less than 25%, in particular less than 10%, of the radius of the nozzle.

According to the invention, the shaping electrode a) is arranged within a ring having a horizontal width of less than the vertical distance between the shaping electrode and the extraction electrode, in particular of less than half the vertical distance between the shaping electrode and the extraction electrode, and/or b) is located at a level above the trench.

Both these measures reduce the tendency of the print head for electrical breakdown. Measure a) allows the electrical field between the shaping electrode and the extraction electrode to laterally fan out, thereby reducing the field strength in a region between the two electrodes. Measure b) increases the distance between the shaping electrode and the extraction electrode while at the same time the interaction is partially shielded by the e.g. grounded liquid inside the nozzle.

Even though the shaping electrode can comprise a plurality of electrode segments distributed around the axis of the nozzle within said ring, the shaping electrode is advantageous annular for generating a rotationally homogeneous field.

Similarly, even though the extraction electrode can comprise a plurality of electrode segments distributed around the axis of the nozzle, the extraction electrode is advantageous annular for generating a rotationally homogeneous field.

Advantageously, the inner diameter of the shaping electrode is smaller than the inner diameter of the extraction electrode. This further decreases the electrical fields between the two electrodes.

In addition or alternatively thereto, and for the same reason, the outer diameter of the shaping electrode is advantageously smaller than the outer diameter of the extraction electrode.

In one embodiment, the print head may comprise a first dielectric layer, a second dielectric layer, and a third dielectric layer. The second dielectric layer is arranged vertically between the third and first dielectric layers. In this case, the following may apply:

The nozzle wall is mounted to the first dielectric layer, i.e. the first dielectric layer acts as a support of the nozzle wall.

The second dielectric layer forms at least part of the nozzle wall, and an annular gap in the second dielectric layer forms at least part of the trench, i.e. the nozzle wall is formed at least partially from the second dielectric layer.

The shaping electrode is arranged on the top or bottom side of the second dielectric layer or between sublayers of the second dielectric layer, which places the shaping electrode radially outside the nozzle.

The extraction electrode is located on a bottom side of the third dielectric layer, which allows to place the extraction electrode at a level below the bottom end of the nozzle.

The print head may further comprise a recess intersected by the axis of the nozzle and located at least in part below the nozzle, with the trench being arranged in communication with a top side of the recess. In other words, the trench is arranged above the recess and opens into the recess. Further, the outer horizontal diameter of the trench is advantageously smaller, in particular by at least 25%, than the horizontal diameter of the recess. Hence, the recess is wider than the trench, thereby allowing to locate the shaping electrode fairly close, in horizontal direction, to the nozzle but still providing a wide exit for the drops of ink.

The recess can advantageously be formed at least in part by an opening in the "third dielectric layer" mentioned above.

The invention also relates to a method for operating such a print head, i.e. for extracting ink from the nozzle. The method comprises the following steps:

Applying an extraction voltage Vext between the ink in the nozzle and the extraction electrode: This voltage extracts ink from the nozzle. This voltage is relative to the electric potential applied at the ink, i.e. the nozzle electric potential.

Applying a shaping voltage Vsh between the ink in the nozzle and the shaping electrode (again, this voltage is relative to the electric potential applied at the ink, i.e. the nozzle electric potential): This voltage laterally shapes the electric vector field. Being close to the perimeter of the nozzle, the shaping electrode mainly couples to the nozzle perimeter while the extraction electrode, acting from a level below the nozzle, couples almost equally strong to the whole nozzle. However, for an ink meniscus to form a semi-elliptical form with its lowest point at the primary nozzle axis, the electric field should be maximized at the nozzle center and minimized at the nozzle perimeter.

The two steps are advantageously applied at the same time, i.e. the two voltages are, at least for some time during ink extraction, applied concurrently to the print head.

The following condition applies for the voltages:

$$|Vext-Vsh|>k\cdot|Vext|,$$

with | . . . | denoting the absolute value and k being a constant larger than 0.5, in particular larger than 0.8.

Furthermore, Vsh is advantageously of opposite electrical polarity as Vext. In this way, the shaping electrode most optimally depletes the electric field at the nozzle perimeter region.

However, also if Vsh and Vext are of same polarity the field shape can be improved. If done so, k must be chosen sufficiently large such that Vsh, upon activation of the extraction electrode, is larger than the electric potential the shaping electrode would obtain if left electrically floating.

It shall be noted that an increase of the absolute voltage |Vext−Vsh| has a negative effect on breakdown resistance. Therefore, k should be kept below 2, in particular smaller than 1.2. Advantageously it is kept close to 1.

Use of the shaping electrode in this way can prevent the formation of non-semielliptical meniscus shape and ejection of droplets that does not occur from the primary nozzle axis. The shaping electrode can also prevent droplets ejected from the perimeter-region of the nozzle to impact onto the side-wall of the recess and thereby fill the recess with ink. Also, the shaping electrode will reduce electrical stress at the nozzle perimeter and thereby the effect of ink being electro-wetted across the nozzle perimeter.

This choice of the voltages allows to generate a large acceleration force at the apex of the ink meniscus while still maintaining a laterally confining field to guide the ink.

The invention also relates to a printer comprising a print head as described here in combination with a signal generator connected to the shaping electrode and the extraction electrode. The signal generator is adapted to carry out the steps of the method as described herein, e.g. by using suitable timing circuitry.

BRIEF DESCRIPTION OF THE DRAWINGS

The invention will be better understood and objects other than those set forth above will become apparent when consideration is given to the following detailed description thereof. Such description makes reference to the annexed drawings, wherein.

MODES FOR CARRYING OUT THE INVENTION

Definitions

Terms such as above, below, top, and bottom are to be understood such that the feed duct is arranged above the nozzle and the extraction electrode is located at a level below the nozzle.

Horizontal designates the directions parallel to the nozzle duct and nozzle axis, and vertical designates the direction perpendicular thereto. Lateral refers to something offset in horizontal direction while overlapping in vertical direction. The expression "at the height" or "at the level" refers to the vertical position of an item.

A dielectric is a material having an electrical conductivity of $10^{-6}$ S/m or less.

An annular electrode is a ring-shaped electrode or an electrode that only slightly deviates from ring shape, such as an electrode formed by a hexagonal conducting strip or an electrode of higher symmetry.

First Embodiment

Figure 1:
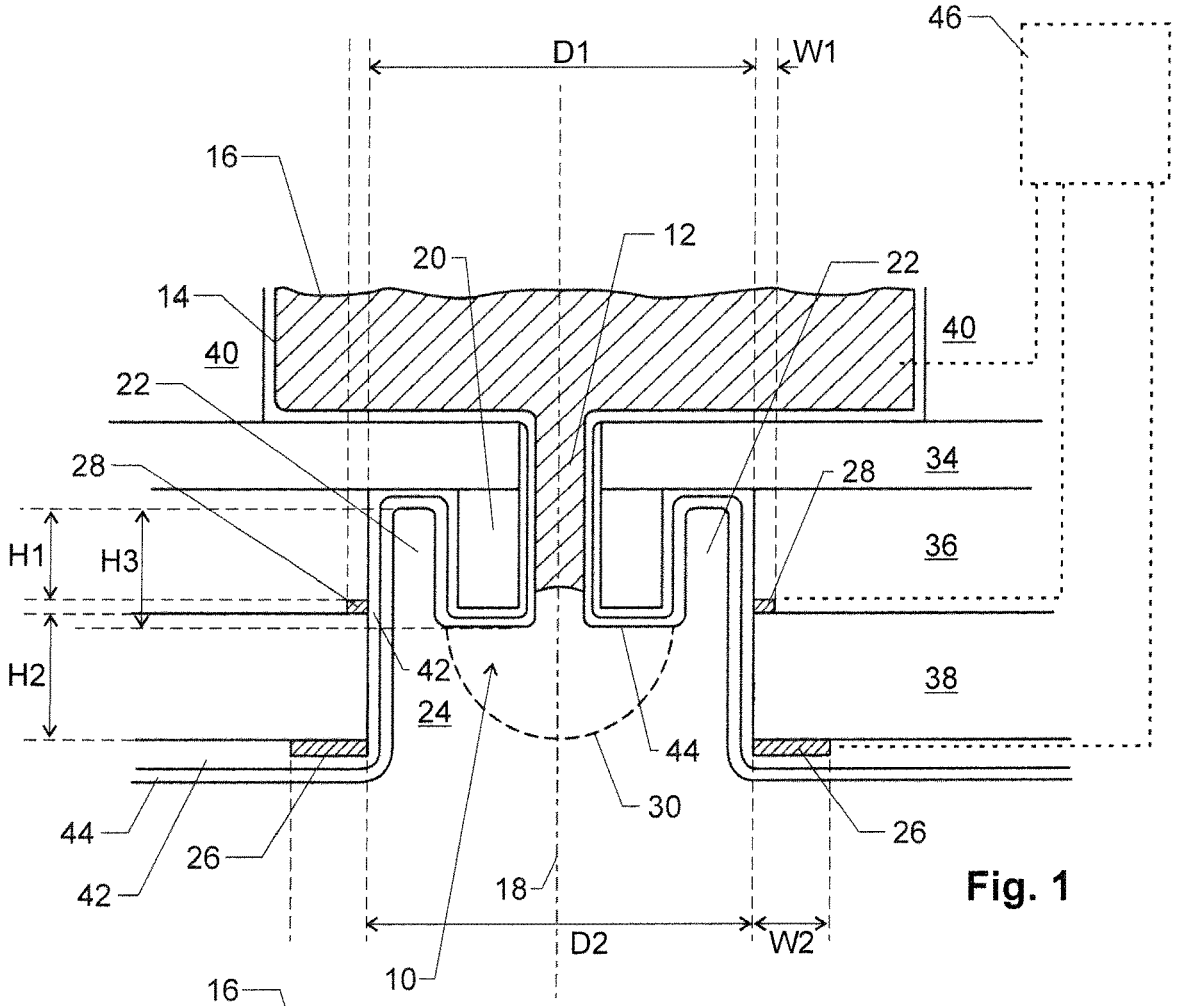
FIG. 1 is a sectional view, at the location of a nozzle, of a first embodiment of a print head.

FIG. 1 shows a first embodiment of a print head. It is similar in design to the one described in WO 2016/120381. The figure only shows the sectional view of a region limited to a single nozzle of the print head.

The print head comprises a plurality of nozzles 10, one of which is shown in FIG. 1.

In all embodiments, nozzle 10 comprises a nozzle duct 12, whose upper end may communicate with an ink feed duct 14 for carrying ink 16 to the nozzle.

Nozzle 10 defines a nozzle axis 18 concentric to nozzle duct 12. A nozzle wall 20 laterally surrounds nozzle duct 12 concentrically to nozzle axis 18.

An annular trench 22 laterally surrounds nozzle wall 20.

Trench 22 opens, at its lower side, into a recess 24. Recess 24 is intersected by axis 18 and is located at least in part below nozzle 10.

An extraction electrode 26, which is advantageously annular, extends around recess 24 at a level below the bottom end of nozzle 10. As described above, it is used to extract ink from nozzle 10.

A shaping electrode 28, which is advantageously annular, extends around trench 22 at a vertical level intersecting with nozzle 10. As described above, it is used to laterally shape the meniscus 30 of the ink as it forms at the bottom end of nozzle 10.

Shaping electrode 28 is arranged within, and advantageously coincides with, a ring having an inner diameter D1 and a horizontal width W1.

Extraction electrode 26 is arranged within, and advantageously coincides with, a ring having an inner diameter D2 and a horizontal width W2.

Further, the vertical distance between shaping electrode 28 and a top end of trench 22 is H1. The vertical distance between shaping electrode 28 and extraction electrode 26 is H2. And the depth of trench 22 is H3.

In the shown embodiment, the width W1 of shaping electrode 28 is less than the vertical distance H2 between shaping electrode 28 and extraction electrode 26. As described above, this leads to a reduced maximum field strength at a vertical level between these two electrodes and therefore reduces the risk of electrical breakthrough.

Advantageously, the width W1 of shaping electrode 28 is even smaller than 0.5×H2, in particular smaller than 0.2×H2. Typically, it is about 0.1×H2. This is particularly true if shaping electrode 28 is located vertically above extraction electrode 26. If the two electrodes are offset in horizontal direction, such as e.g. shown in the embodiments of FIGS. 3 and 4, shaping electrode 28 may, in some embodiments, also have a larger width.

Width W2 of extraction electrode 26 exceeds, advantageously by at least a factor 2, width W1 of shaping electrode 28. This is based on the understanding that shaping electrode 28 can be very narrow and still fulfill its task of laterally shaping meniscus 30 while extraction electrode should be wider in order to generate a more uniform electric field at the nozzle, particularly at the center of the nozzle.

For the same reason, the outer diameter 2·W1+D1 of shaping electrode 28 is smaller, advantageously by at least 10%, than the outer diameter 2·W2+D2 of extraction electrode 26.

In the shown embodiment, the vertical position of shaping electrode 28 coincides with the bottom end of nozzle 10. In this context, "coincides with" advantageously indicates a deviation of less than 10% of the height H3 of trench 22. At this location, shaping electrode 28 is very close to the laterally outmost parts of meniscus 30 and is able to exert a force that prevents them for spreading outwards further.

The print head has basically a layer structure and is manufactured by suitably patterning these layers.

In the shown embodiment, it comprises a first dielectric layer 34, a second dielectric layer 36, and a third dielectric layer 38, with second dielectric layer 36 being arranged vertically between first dielectric layer 34 and third dielectric layer 38.

Nozzle wall 20 is mounted at a bottom side of first dielectric layer 34.

Trench 22 is formed by an annular opening in second dielectric layer 36. Thus, the annular nozzle wall 20 is formed by a ring-shaped part of second dielectric layer 36.

Recess 24 is formed by an opening in third dielectric layer 38.

FIG. 1 shows some further elements of the print head.

Ink feed duct 14 is formed by a vertical opening in a dielectric feed layer 40, which is located above first dielectric layer 34.

A dielectric coating 42 covers at least one, in particular both, of the electrodes 26, 28 for reducing the risk of dielectric breakdown in air.

An anti-wetting (liquid-repellant) coating 44 covers at least the exterior walls of nozzle 10, trench 22, and recess 24.

A complete printer with the print head will further comprise a signal generator 46 adapted to generate voltages, in particular pulsed voltages, and apply them to ink 16, extraction electrode 26, and shaping electrode 28, as well as to any other electrodes in the printer, such as an acceleration electrode located at the target. For more details, see e.g. WO 2016/120381.

The applied voltages and operating steps of the print head will be described in more detail in the section "operating method" below.

Second Embodiment

Figure 2:
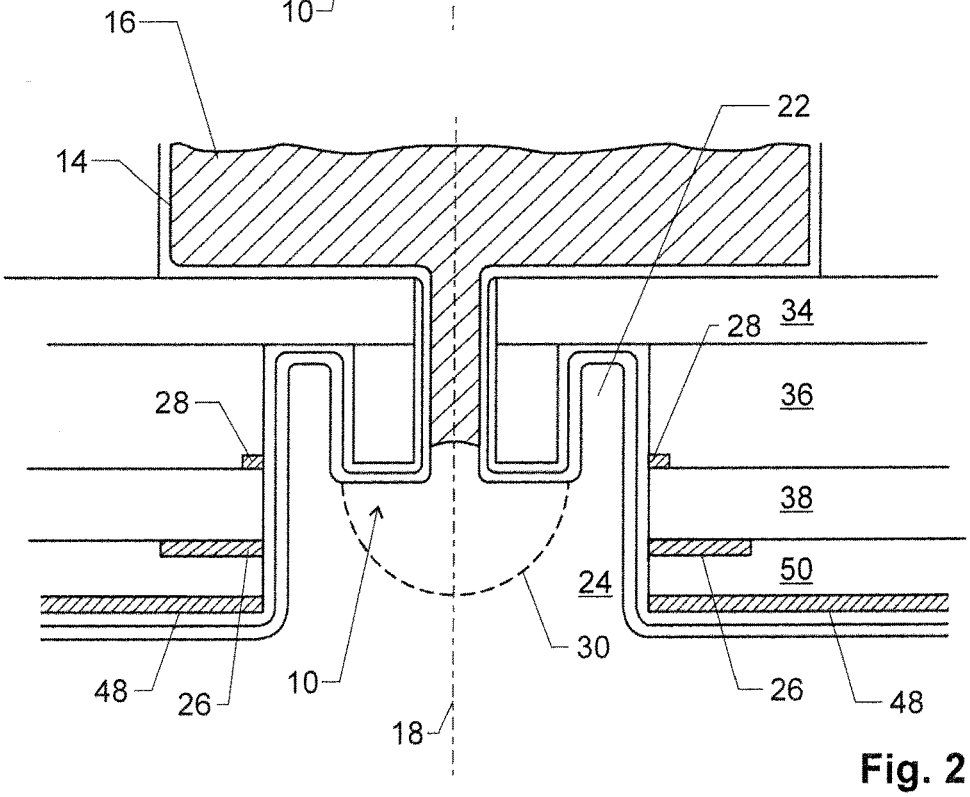
FIG. 2 is a sectional view of a second embodiment of a print head with a shield electrode.

FIG. 2 shows a second embodiment of the print head. It differs from the one the one of FIG. 1 in that it comprises a shielding electrode 48 arranged around axis 18 of nozzle 10 at a level below extraction electrode 26. Advantageously, the lateral extension of shielding electrode is much larger than the lateral extension of extraction electrode 26, and it advantageously continuously extends over the locations of several nozzles 10 of the print head.

A fourth dielectric layer 50 is arranged between extraction electrode 26 and shielding electrode 48.

An opening in fourth dielectric layer 50 forms part of recess 24.

In the embodiment of FIG. 2, recess 24 has the same diameter at third dielectric layer 38 and fourth dielectric layer 50. However, the diameter of recess 24 at fourth dielectric layer 50 may also be larger than the diameter at third dielectric layer 38, which further reduces the risk of droplets impacting on the lateral walls of recess 24 and exposes more of extraction electrode 38 for coupling with the nozzle 10.

The latter effect by itself can also be achieved by increasing the inner diameter of the shielding electrode 48 while keeping the diameter of the recess 24 at the fourth dielectric layer 50 identical to the diameter of the recess 24 at the third dielectric layer 38. Of course, also combinations are possible, e.g. the difference between the inner diameter of the shielding electrode 48 and the inner diameter of the extraction electrode 26 may be larger than the difference between the diameter of the recess at the fourth dielectric layer 50 and the third dielectric layer 38.

In any case and for any of the embodiments, the inner diameter of the shielding electrode 48 is advantageously not larger than the outer diameter of the extraction electrode 26, in order to improve the electric shielding effect between neighboring nozzles.

Note that such a shielding electrode 48 can be advantageously used with any of the print heads shown or described herein.

Third Embodiment

Figure 3:
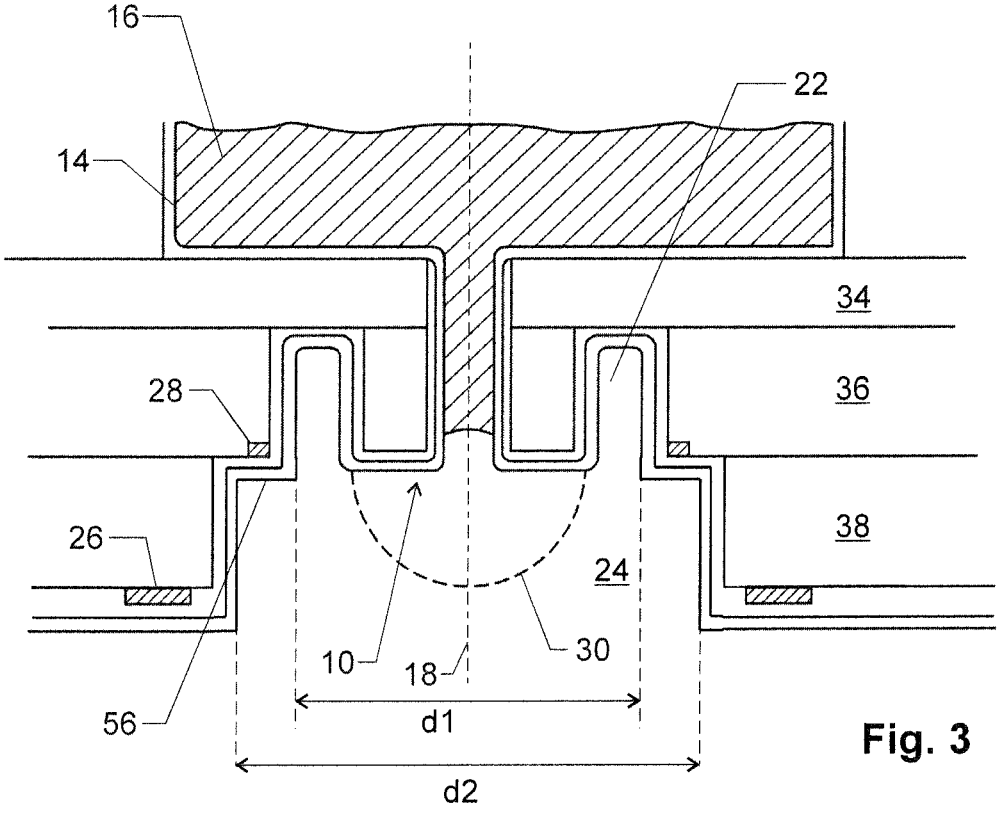
FIG. 3 is a sectional view of a third embodiment of a print head with an exit recess wider than the trench around the nozzle.

The third embodiment of FIG. 3 differs from the previous embodiments in that the outer diameter d1 of annular trench 22 is smaller than the diameter d2 of recess 24.

This further reduces the coupling between extraction electrode 26 and shaping electrode 28 as it allows to increase the distance between them, while at the same time the coupling between the nozzle 10 perimeter and the shaping electrode 28 is comparably enhanced, which means that |Vext−Vsh| can be increased without jeopardizing breakdown resistance. It also reduces the risk of droplets impacting on the lateral walls of recess 24.

Figure 7:
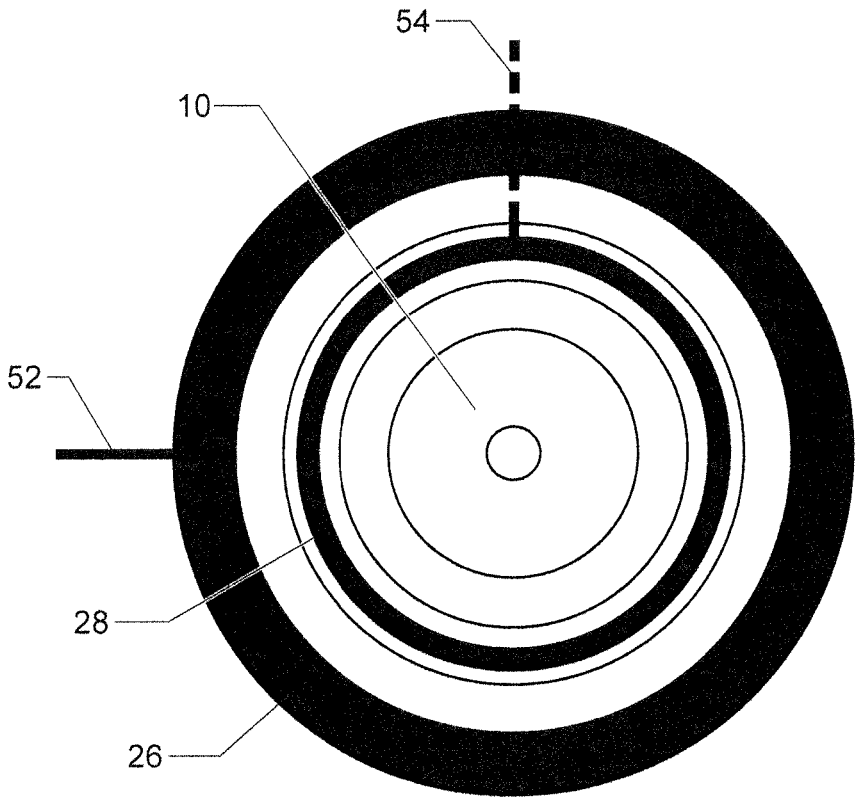
FIG. 7 is a view of the embodiment of FIG. 3 from below with illustrating an annular design of the shaping electrode and the extraction electrode, with the electrodes shown in black.

FIG. 7 shows a bottom view of the third embodiment with the two electrodes 26, 28 shown in black. As can be seen, they are both annular and concentric.

FIG. 7 also shows electrical leads 52, 54 connecting the electrodes 26, 28 to signal generator 46. Again, to prevent large electric field from forming between the shaping electrode 28 and the extraction electrode 26, the electrical lead 54 attached to the shaping electrode 28 should be formed with a small width when passing across the extraction electrode 26. The width of electrical lead 54 may even be smaller than the width of the shaping electrode itself 28, at least within a crossing region with the extraction electrode 26, such crossing region extending beyond the outer diameter of the extraction electrode 26 by at least a value that is equal to the lateral distance between shaping electrode 28 and extraction electrode 26.

Alternatively, the electrodes may e.g. also comprise a plurality of mutually separate electrode segments arranged on a circle. Also, these segments of the two electrodes 26, 28 may be angularly offset in order to further reduce the coupling between the electrodes.

Such electrode designs can be used for all embodiments shown herein.

Fourth Embodiment

Figure 4:
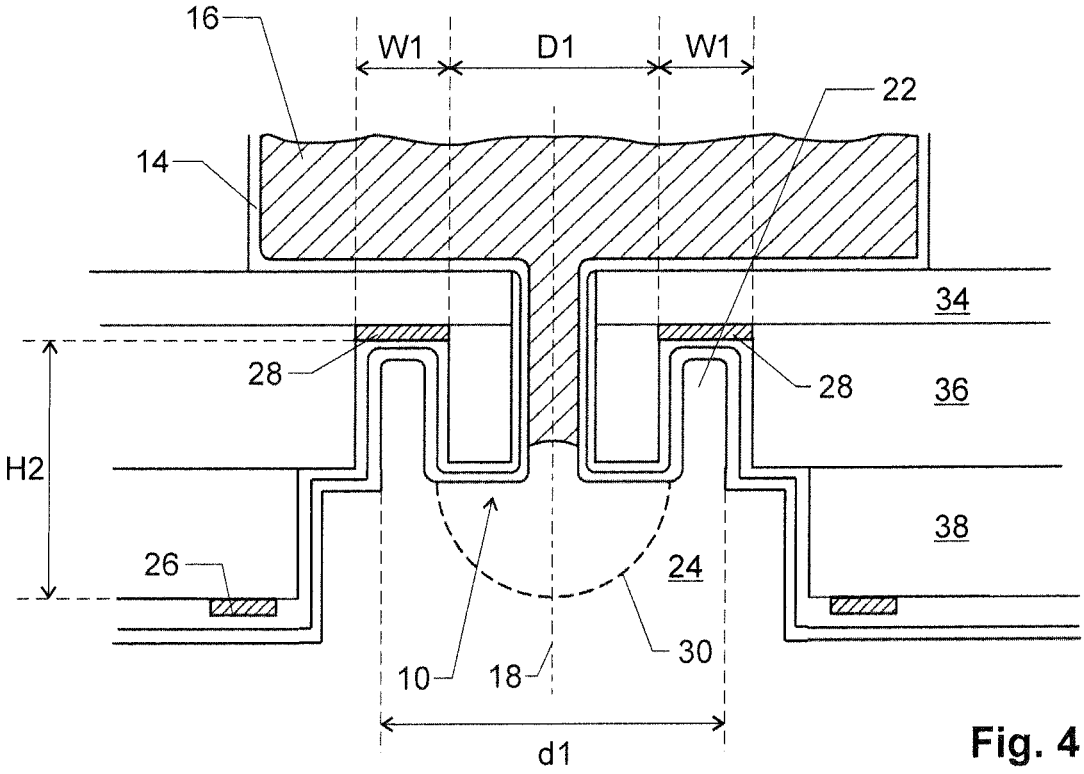
FIG. 4 is a sectional view of a fourth embodiment of a print head with the shaping electrode above the trench.

The fourth embodiment of FIG. 4 differs from the previous embodiments in that shaping electrode 28 is located at a vertical level above trench 22.

In this case, the vertical distance H2 between shaping electrode 28 and extraction electrode 26 is larger than in the previous embodiments, and therefore the risk of breakthrough is reduced, and therefore the voltage |Vext−Vsh| may be increased without jeopardizing breakdown resistance.

In this embodiment, the horizontal width W1 of shaping electrode 28 is still less than the vertical distance H2 between shaping electrode 28 and extraction electrode 26, same as in the previous embodiments.

This design, however, allows to make the inner diameter D1 of shaping electrode smaller, in particular smaller than the outer diameter d1 of trench 22. Hence, the shaping electrode can be somewhat closer to the periphery of meniscus 30 and compensate for the somewhat larger vertical distance between the shaping electrode and the meniscus as compared to the previous embodiments.

Additionally, the electric coupling to the perimeter of the meniscus 30 is strongly increased relative to the coupling to the center of the meniscus 30, potentially it may even become too confined such that the shaping electrode 28 is less efficient in preventing droplet release close to the meniscus 30 periphery. Also, there is an increased risk that ejected droplets hit the wall of the recess 24.

The effect of the shaping electrode 28 can strongly enhanced by choosing the material of the second dielectric layer 36 to have a high relative permittivity, advantageously of at least 4. Alternatively or in addition thereto, second dielectric layer 36 has a higher relative permittivity than third dielectric layer 38, advantageously by at least 20%, in particular by at least 100%, such as e.g. by 150%-250%. In this way, the electric potential between the second 36 and third dielectric layers 38, at the region of the recess 24, can be shifted towards Vsh, as compared to the case when both the second 36 and third dielectric layers 38 were of the same material. In this way, an almost similar electric environment can be created as in the previous embodiments but at substantially reduced likelihood of electrical breakdown, due to the larger distance between shaping and extraction electrode. The chance of breakdown is further reduced because the electric energy density within second dielectric layer 36 is comparably smaller than the electric energy density within the third dielectric layer 38.

This adjustment of the relative permittivity of the second and third dielectric layers 36, 38 can be used in any of the embodiments of the invention.

For example, the second dielectric layer 36 can be made of a high-permittivity dielectric like Silicon Nitride or Silicon Oxynitride while the third dielectric layer 38 can be made of a low-permittivity dielectric like polymeric BCB or SU8. Based on these materials, a relative difference in permittivity up to a factor of ~3.4 is possible.

Fifth Embodiment

Figure 5:
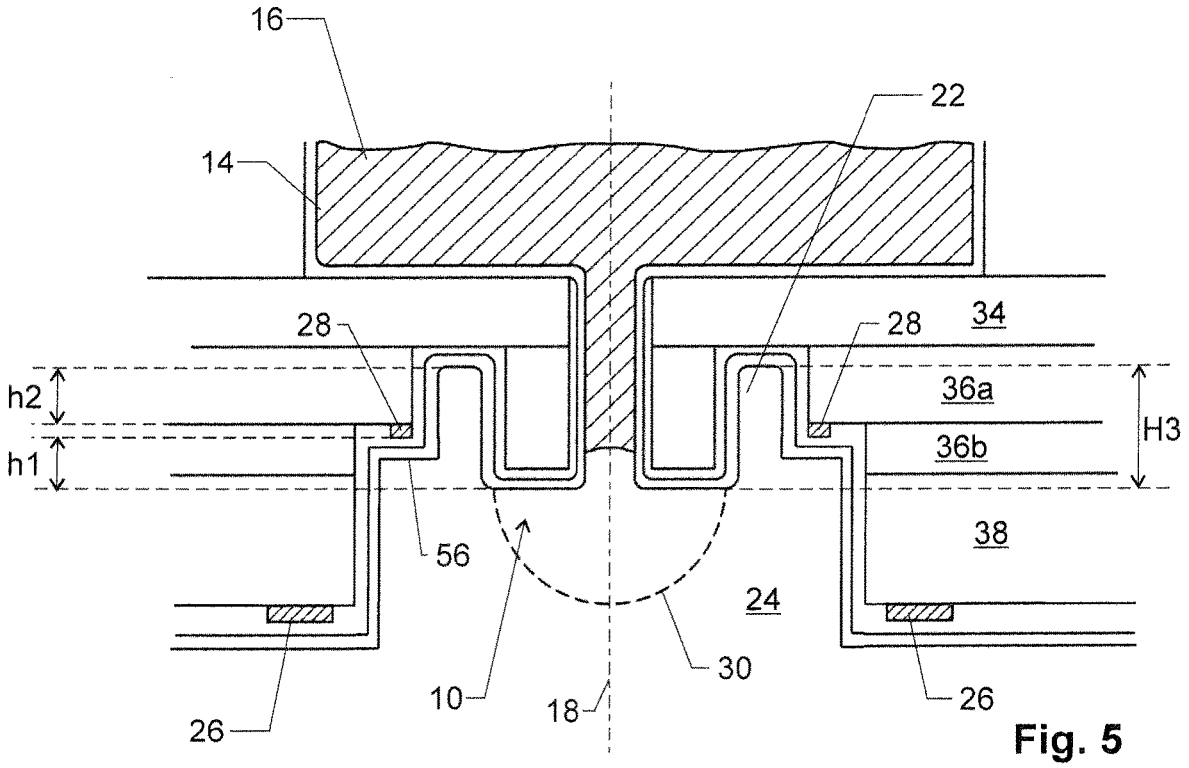
FIG. 5 is a sectional view of a fifth embodiment of a print head with the shaping electrode at intermediate height.

The fifth embodiment of FIG. 5 differs from the previous embodiments in that the vertical position of shaping electrode 28 is neither at the top nor at the bottom of nozzle 10 but rather somewhere in between these positions.

To explain the geometry of this design, we first define the following parameters:

- h1 is the vertical distance between shaping electrode 28 and the bottom of nozzle 10.
- h2 is the vertical distance between shaping electrode 28 and the top of trench 22.
- H3 is the height (i.e. the vertical extension) of trench 22 as measured between the bottom of nozzle 10 and the top of trench 22.

In this case, advantageously, at least one of the following criteria are met:

- The vertical distance h1 between shaping electrode 28 and the bottom of nozzle 10 is at least 10%, in particular at least 25%, of the height H3 of trench 22.
- The vertical distance h2 between shaping electrode 28 and the top end of trench 22 is at least 10%, in particular at least 25%, of the height H3 of trench 22.

This design allows to bring shaping electrode 28 closer to meniscus 30 while still maintaining a larger distance between shaping electrode 28 and extraction electrode 26.

In both the embodiments of FIGS. 3 and 5, shaping electrode 28 is located at a ledge 56.

In the embodiment of FIG. 5, second dielectric layer 36 comprises two sublayers 36*a*, 36*b* in order to form a support for shaping electrode 28 at its intermediate level. Shaping electrode 28 is arranged between the two sublayers 36*a*, 36*b*.

Again, particularly sublayer 36*b* may be made of a high-k dielectric while at least third dielectric layer 38 can be made of a low-k dielectric, in order to confine electric energy within the two dielectric layers mainly to the third dielectric 38. In other words, sublayer 36*b* has a higher relative permittivity (advantageously by at least 20%, in particular by at least 100%) than third dielectric layer 38.

Sixth Embodiment

Figure 6:
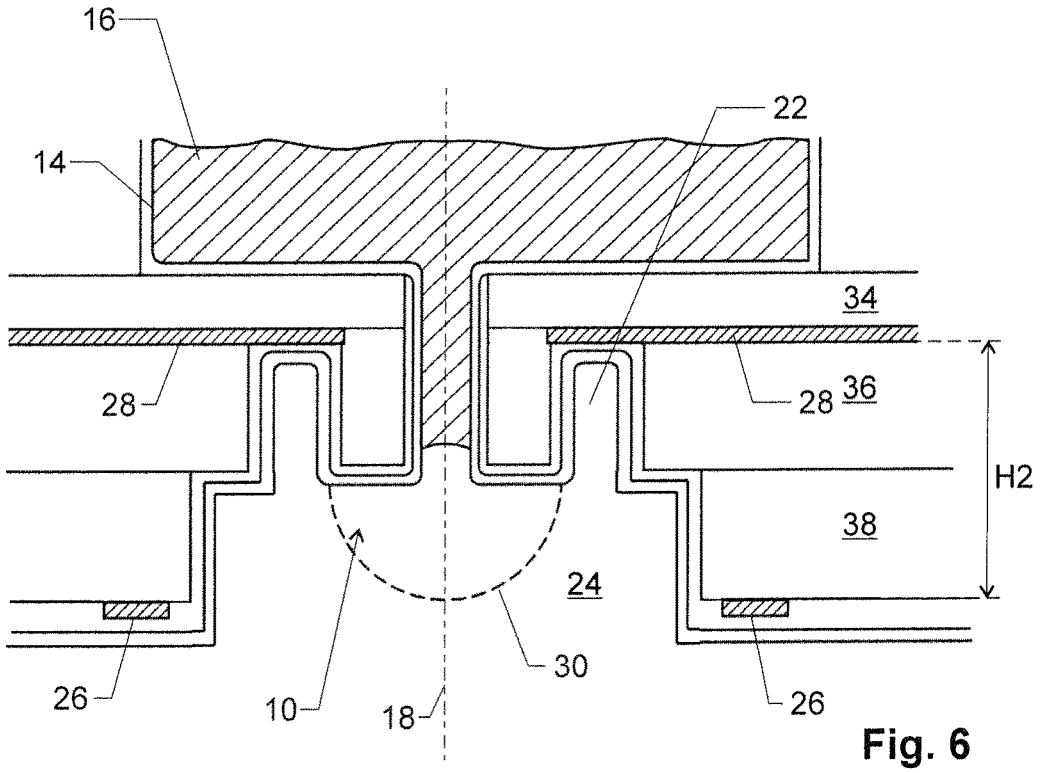
FIG. 6 is a sectional view of a sixth embodiment of a print head with an extended shaping electrode.

The sixth embodiment of FIG. 6 basically corresponds to the fourth embodiment of FIG. 4, but here shaping electrode 28 has a horizontal extension that exceeds the distance H2 between shaping electrode 28 and extraction electrode 26. Still, since shaping electrode 28 is located above trench 22, the distance H2 between shaping electrode 28 and extraction electrode 26 is fairly large and therefore the electrical field between the two electrodes is small. Again, shaping performance is improved and change of dielectric breakdown reduced if the relative permittivity of dielectric layer 38 is chosen larger than the permittivity of dielectric layer 36.

Operating Method

To extract ink from nozzle 10 of the print head, the following steps are carried out:

1. An extraction voltage Vext is applied between the ink 16 in nozzle 10 and extraction electrode 26.
2. A shaping voltage Vsh is applied between the ink 16 in nozzle 10 and shaping electrode 28.

Typically, steps 1 and 2 will temporarily overlap, i.e. take place at least in part at the same time.

Once turned on, shaping voltage Vsh is preferably applied in a continuous fashion while only extraction voltage Vext is being turned on and off. It needs to be understood that droplets are only ejected due to the action of the extraction electrode. Hence, keeping shaping electrode turned on will not create droplets.

In other words, the method may include the step of holding the shaping voltage Vsh fixed while pulsing the extraction voltage Vext.

The level of extraction voltage Vext will define ejection wherein at a certain voltage level there is a meniscus created at the nozzle exit, but there are no droplets ejected yet. It is advantageous to render this situation as an off-state. In this way, to eject droplets, it is only necessary to change the value of Vext slightly. Furthermore, since the meniscus is already present, faster droplet ejection dynamics can be achieved. To achieve an offset off-state it can be advantageous to change the electric potential at the nozzle, i.e. at the ink. For example, the electrical potential at the ink could be −200V, the electric potential at the shaping electrode could be −250V, and the off- and on-stage voltage at the extraction electrode could be 0V and 50V, respectively.

In other words, the method may include the step of ejecting drops of ink by switching said extraction voltage Vext from a first voltage Vext1 to a second voltage Vext2, wherein $|Vext2|>|Vext1|$, wherein the first and second voltage Vext1 and Vext2 have equal sign and both their absolute values are larger than zero. Between ejecting drops, the extraction voltage Vext is advantageously kept at the first voltage Vext1.

Advantageously, $|Vext2|<2.0\times|Vext1|$, in particular $|Vext2|<1.5\times|Vext1|$. In other words, the change between the two voltages is small for fast droplet ejection.

In the following and preceding, Vext and Vsh are referred to as the voltage (with respect to the electric potential of the nozzle) during the on-state.

As mentioned above, the following relation holds true for the voltages:

$$|Vext-Vsh|>k\cdot|Vext|, \quad (1)$$

with k as defined above.

Advantageously, and as mentioned above, extraction voltage Vext and shaping voltage Vsh have opposite sign.

Typically, the absolute value of shaping voltage Vsh is much smaller than the absolute value extraction voltage Vext, i.e.

$$|Vext|>c1\cdot|Vsh|, \quad (2)$$

with constant c1 being at least 2, in particular at least 4. This assures that the shaping electrode does not cause droplet ejection despite its closeness to the nozzle.

c1 can be particularly large, e.g. c1=10, in the embodiment of FIG. 1, where the vertical position of shaping electrode 26 coincides with the vertical position of the bottom end of nozzle 10.

In absolute numbers, we e.g. have

Vext=300 V and

Vsh=−30 V for nozzle geometries e.g. having sizes corresponding to those of WO 2016/120381.

The main purpose of the electrodes is the maximization of the electric field at the apex of meniscus 30 while keeping the electrical forces at the lateral edges of meniscus 30 low. This allows to give the meniscus a substantially hemispherical shape or a semielliptical shape where the largest curvature is achieved at the apex.

Without the help of shaping electrode 28, meniscus 30 might spread laterally and/or have its apex off-center, which would lead to uncontrolled droplet extraction.

Shaping electrode 28 also helps to laterally guide the extracted droplets and maintain them at the location of axis 18 and prevent them from impacting on the lateral walls of trench 22 or recess 24.

Shielding electrode 48 is, during extraction, advantageously on a potential substantially equal to extraction electrode 28, i.e. the voltage Vshield between the ink and shielding electrode 48 fulfills:

$$|Vshield-Vext|<c2\cdot|Vext|, \quad (3)$$

with constant c2 being no more than 0.5, in particular no more than 0.1.

Like the shaping electrode, the shielding electrode is advantageously not intermittently turned off and on but instead remains activated while only the extraction electrode is being switched between on and off stage.

It should be noted that the print head may also be operated in an AC-mode, wherein the voltage polarity of any electrode is switched at a regular interval, at the same time. An AC-operation mode can be advantageous in neutralizing charge on the substrate.

Notes

Advantageously, the second dielectric layer 36 is vertically adjacent to the first and/or third dielectric layer 34, 38. In this context, two layers are understood to be "adjacent" if there is no intermediate dielectric layer between them or any intermediate dielectric layer between them is thinner by at least a factor ten of the thinner one of the two layers.

Shaping electrode 28, extraction electrode 26, and/or shielding electrode 48 are advantageously metal layers.

Advantageously, shaping electrode 28 is thin in vertical direction. It is typically arranged between dielectric layers, in particular the second and third dielectric layers 36, 38 and/or the two sublayers 36*a*, 36*b*, and the vertical thickness of the shaping electrode is smaller by at least a factor 2, in particular by at least a factor 5, as compared to the vertical height H3 of trench 22.

As mentioned, the printing head typically comprises a plurality of the nozzles 10, e.g. arranged in one or more a regular arrays.

Trench 22 is typically closed at its top side and open at its bottom side.

Both, trench 22 and recess 24 are advantageously concentric to nozzle axis 18.

In the embodiments above, nozzle 10 is shown to have cylindrical outer circumference at the location of trench 22. In may, however, also have a different outer shape, e.g. with an undercut as shown in FIGS. 8 and 9 of WO 2016/120381 for reducing the tendency of the ink to wet the walls of the trench.

The shaping electrodes 28 may be electrically connected, e.g. by electrical vias, to feed lines e.g. arranged in an interposer layer to feed voltages to them. Such an interposer layer can e.g. be located at feed layer 40 and/or above feed layer 40.

In many applications, the shaping electrodes 28 of several nozzles 10 can be applied to the same electrical potential. This can e.g. be achieved by interconnecting several shaping electrodes, e.g. with horizontal interconnecting lines, such as line 54 in FIG. 7, which reduces the number of electrical connections, such as vias, for contacting them.

Figure 8:
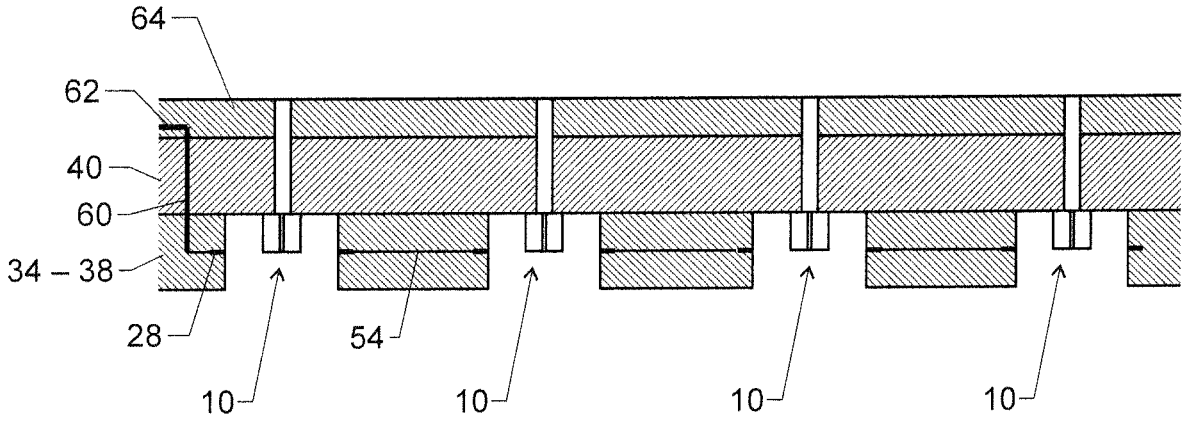
FIG. 8 is a schematic representation of a print head illustrating an embodiment to electrically connect the shaping electrodes (note that, for simplicity, none of the other electrodes are shown in this figure).

This is illustrated in FIG. 8, which shows the interconnect lines 54 connecting several shaping electrodes 28. The figure also shows a via 60 extending vertically through at least part of the print head to at least one feed line 62 in a layer 64 above the nozzles 10.

Hence, in more general terms, the print head may comprise interconnect lines 54 interconnecting at least several shaping electrodes 28 of different nozzles 10, in particular wherein said interconnect lines 54 are horizontal.

In this case, there may be a common vertical via 60 connecting said several shaping electrodes 28 to at least one feed line 62 above the nozzles 10.

While there are shown and described presently preferred embodiments of the invention, it is to be distinctly understood that the invention is not limited thereto but may be otherwise variously embodied and practiced within the scope of the following claims.

The invention claimed is:

1. An electrohydrodynamic print head comprising
- at least one nozzle having a central nozzle duct laterally surrounded by a nozzle wall,
- an annular trench laterally surrounding said nozzle,
- an extraction electrode located around an axis of said nozzle at a level below said nozzle,
- a shaping electrode located laterally outside said nozzle duct, wherein said shaping electrode
- is arranged within a ring having a horizontal width W1 of less than a vertical distance between said shaping, electrode and said extraction electrode and/or
- is located at a level above said trench.

2. The print head of claim 1 wherein said shaping electrode is annular.

3. The print head of claim 1 wherein said extraction electrode is annular.

4. The print head of claim 1 wherein the horizontal width W1 of the ring is smaller than 0.5 times the vertical distance H2 between said shaping electrode and said extraction electrode.

5. The print head of claim 1 wherein an inner diameter D1 of said shaping electrode is smaller than an inner diameter D2 of said extraction electrode.

6. The print head of claim 1 wherein said extraction electrode has a width W2 exceeding the width W1 of said ring.

7. The print head of claim 1 wherein an outer diameter 2·W1+D1 of said shaping electrode is smaller than an outer diameter 2·W2+D2 of said extraction electrode.

8. The print head of claim 1 wherein said shaping electrode is vertically arranged between two dielectric layers and wherein a vertical thickness of said shaping electrode is smaller by at least a factor 2 as compared to a vertical height H3 of said trench.

9. The print head of claim 1 further comprising a first dielectric layer, a second dielectric layer, and a third dielectric layer, with said second dielectric layer being arranged vertically between said third and first dielectric layer, and wherein
- said nozzle wall is mounted to said first dielectric layer,
- said second dielectric layer forms at least part of said nozzle wall,
- an annular gap in said second dielectric layer forms at least part of said trench,
- said shaping electrode is arranged on a top or bottom side of said second dielectric layer or between sublayers of the second dielectric layer, and
- said extraction electrode is located on a bottom side of said third dielectric layer.

10. The print head of claim 9 wherein
- said second dielectric layer has a relative permittivity of at least 4 and/or
- said second dielectric layer has a higher relative permittivity than said third dielectric layer.

11. The print head of claim 10 wherein said second dielectric layer has at least one of
- a relative permittivity of at least 4 and
- a higher relative permittivity than said third dielectric layer by at least 20%.

12. The prim head of claim 9 further comprising a recess intersected by the axis of the nozzle and located at least in pan below the nozzle, wherein said trench is arranged in communication with a lop side of said recess, wherein an outer diameter d1 of said trench is smaller than a diameter d2 of the recess, and wherein said recess is formed at least in part by an opening in said third dielectric layer.

13. The print head of claim 10 wherein said second dielectric layer has at least one of
- a relative permittivity of at least 4 and
- a higher relative permittivity than said third dielectric layer by at least 100%.

14. The print head of claim 1 further comprising a recess intersected by the axis of the nozzle and located at least in part below the nozzle, wherein said trench is arranged in communication with a top side of said recess, and wherein an outer diameter d1 of said trench is smaller than a diameter d2 of the recess.

15. The print head of claim 14 wherein the outer diameter d1 of said trench is smaller by at least 25% than the diameter d2 of the recess.

16. The print head of claim 1 wherein said shaping electrode is arranged at least in part at horizontal ledge.

17. The print head of claim 1 further comprising a shielding electrode arranged around the axis of said nozzle at a level below said extraction electrode.

18. The print head of claim 1 wherein
- a vertical distance h1 between said shaping electrode and a bottom end of said nozzle is at least 10% of a height of said trench and/or
- a vertical distance between said shaping electrode and a top end of said trench is at least 10% of a height of said trench.

19. The print head of claim 18 wherein
- the vertical distance h1 between said shaping electrode and the bottom end of said nozzle is at least 25% of the height of said trench and/or
- the vertical distance h2 between said shaping electrode and the top end of said trench is at least 25% of a height of said trench.

20. The print head of claim 1 wherein a vertical position of said shaping electrode coincides with a bottom end of said nozzle.

21. The print head of claim 1 wherein an inner diameter D1 of said extraction electrode is smaller than an outer diameter d1 of said trench.

22. A method for operating the print head of claim 1 comprising, for extracting ink from said nozzle, applying an extraction voltage Vext between ink in said nozzle and said extraction electrode and, applying a shaping voltage Vsh between the ink in said nozzle and said shaping electrode, wherein $$|Vext-Vsh|>k\cdot|Vext|$$

wherein k is a constant larger than 0.5.

23. The method of claim 22 wherein k is smaller than 2.

24. The method of claim 22 wherein said extraction voltage Vext and said shaping voltage Vsh have opposite sign.

25. The method of claim 22 comprising holding the shaping voltage: Vsh fixed while pulsing the extraction voltage Vext.

26. The method of claim 22 comprising ejecting drops of ink by switching said extraction voltage Vext from a first voltage Vext1 to a second voltage Vext2, wherein |Vext2|>|Vext1|, wherein the first and second voltage Vext1 and Vext2 have equal sign and their absolute values are larger than zero.

27. The method of claim 26 wherein |Vext2|<2.0×|Vext1|.

28. The method of claim 22 wherein k is at least one of larger than 0.8 and smaller than 1.2.

29. A printer comprising the print head of claim 1 and a signal generator connected to said shaping electrode and said extraction electrode, wherein said signal generator is adapted to carry out a method of for extracting ink from a nozzle, that includes applying an extraction voltage Next between ink in said nozzle and said extraction electrode and, applying a shaping ta e Vsh between the ink in said nozzle and said shaping electrode, wherein $$|Vext-Vsh|>k\cdot|Vext|$$

wherein k is a constant larger than 0.5.

* * * * *